US008900109B2

(12) United States Patent
Pease

(10) Patent No.: US 8,900,109 B2
(45) Date of Patent: Dec. 2, 2014

(54) PLASTIC BAG, A NOVEL INTERMEDIATE PRODUCT, METHODS FOR MAKING THE BAG AND INTERMEDIATE PRODUCT, AND IMPROVED POUCH MACHINE

(75) Inventor: James F. Pease, Lake in the Hills, IL (US)

(73) Assignee: KV-LOCK LLC, Miami, FL (US)

( * ) Notice: Subject to any disclaimer, the term of this patent is extended or adjusted under 35 U.S.C. 154(b) by 754 days.

(21) Appl. No.: 13/178,194

(22) Filed: Jul. 7, 2011

(65) Prior Publication Data

US 2012/0035036 A1 Feb. 9, 2012

Related U.S. Application Data

(63) Continuation-in-part of application No. PCT/US2010/054008, filed on Oct. 26, 2010.

(60) Provisional application No. 61/286,069, filed on Dec. 14, 2009.

(51) Int. Cl.
*B31B 1/62* (2006.01)
*B65D 65/28* (2006.01)
*B31B 19/90* (2006.01)

(52) U.S. Cl.
CPC ..... *B31B 19/90* (2013.01); *B31B 2219/6092* (2013.01); *B31B 2237/50* (2013.01)
USPC ..... 493/212; 493/264; 428/43

(58) Field of Classification Search
CPC ..... B31B 19/90; B31B 2237/50; B31B 2219/6092
USPC ..... 493/212, 213, 264; 428/43
See application file for complete search history.

(56) References Cited

U.S. PATENT DOCUMENTS 4,953,708 A 9/1990 Beer et al.
5,172,980 A * 12/1992 Provost ..... 383/204
(Continued)

FOREIGN PATENT DOCUMENTS

CA 2348034 5/2000
JP 2002-529169 A 9/2002
(Continued)

OTHER PUBLICATIONS

International Search Report dated Jul. 25, 2011 for PCT/US10/54008.
(Continued)

*Primary Examiner* — Hemant M Desai
(74) *Attorney, Agent, or Firm* — Fleit Gibbons Gutman Bongini & Bianco PL; Martin Fleit; Paul D. Bianco

(57) ABSTRACT

An intermediate product for making bag closures wherein an elongated substrate has formed on it a pair of elongated attachment lanes having complementary fastening elements to provide an attachable-detachable closure. The lanes extend parallel and are spaced apart. A perforation line is formed in the substrate between the lanes. The tape is folded by being pulled through a slot along the perforation line to place said lanes in face-to-face engagement. The product is used in a method for making bags or pouches and on a machine modified to seal partially one side of the closure to one side of the mouth of bags or pouches being made and to seal completely the other side of the closure to the other side of the bag of pouch mouth. The perforation is separated to separate the lanes and create an attachable-detachable closure. Interlocking projections can be included in the closure.

20 Claims, 13 Drawing Sheets

(56) References Cited

U.S. PATENT DOCUMENTS

| | | | | |
|---|---|---|---|---|
| 6,202,260 | B1 | 3/2001 | Clune et al. | |
| 6,481,183 | B1 * | 11/2002 | Schmidt | 53/412 |
| 6,656,403 | B1 | 12/2003 | Clune et al. | |
| 6,871,473 | B1 | 3/2005 | Dutt et al. | |
| 6,986,237 | B2 | 1/2006 | Ausnit et al. | |
| 6,991,375 | B2 | 1/2006 | Clune et al. | |
| 7,093,409 | B2 | 8/2006 | Dutt et al. | |
| 7,163,706 | B2 | 1/2007 | Shepard et al. | |
| 7,308,783 | B2 * | 12/2007 | Shepard et al. | 53/452 |
| 7,406,810 | B2 * | 8/2008 | Clune et al. | 53/412 |
| 7,424,796 | B2 | 9/2008 | Shepard et al. | |
| 8,051,540 | B2 * | 11/2011 | Gallant et al. | 24/306 |
| 2003/0031386 | A1 * | 2/2003 | Shepard et al. | 383/61.1 |
| 2003/0142888 | A1 | 7/2003 | Provost et al. | |
| 2003/0228078 | A1 | 12/2003 | Clune et al. | |
| 2004/0008909 | A1 | 1/2004 | Shepard et al. | |
| 2004/0131731 | A1 | 7/2004 | Shepard et al. | |
| 2005/0086911 | A1 | 4/2005 | Dutt et al. | |
| 2006/0062496 | A1 | 3/2006 | Clune et al. | |
| 2006/0162289 | A1 | 7/2006 | Shepard et al. | |
| 2008/0041022 | A1 * | 2/2008 | Shepard et al. | 53/469 |
| 2008/0131035 | A1 | 6/2008 | Rogers | |
| 2009/0013644 | A1 | 1/2009 | Yeager | |
| 2011/0116730 | A1 | 5/2011 | Kawakami et al. | |
| 2012/0270712 | A1 | 10/2012 | Pease | |

FOREIGN PATENT DOCUMENTS

| | | | |
|---|---|---|---|
| JP | 2004-505807 | A | 2/2004 |
| JP | 2005-206162 | A | 8/2005 |
| JP | 2009-046156 | A | 3/2009 |
| WO | 2011/081703 | | 7/2011 |
| WO | 2011/081923 | | 7/2011 |

OTHER PUBLICATIONS

Written Opinion for PCT/US10/54008 dated Jul. 21, 2011.

International Preliminary Report on Patentability published Jun. 19, 2012 for PCT/US2010/060260.

International Preliminary Report on Patentability for PCT/US10/54008 published Jun. 19, 2012.

International Search Report published Nov. 17, 2011 Jun. 19, 2012 for PCT/US2010/060260.

International Search Report for PCT/US10/54008 published Sep. 15, 2011.

* cited by examiner

PLASTIC BAG, A NOVEL INTERMEDIATE PRODUCT, METHODS FOR MAKING THE BAG AND INTERMEDIATE PRODUCT, AND IMPROVED POUCH MACHINE

This application is a continuation-in-part of PCT Patent Application No. PCT/US2010/054008 filed Oct. 26, 2010, which claims priority from Provisional Patent Application No. 61/286,069 filed Dec. 14, 2009.

BACKGROUND OF THE INVENTION

1. Field of Invention

The present invention relates to a plastic bag or pouch having a novel closure, a novel intermediate product used for the closure, and to methods for making the plastic bag and the intermediate product. More particularly, the invention relates to a pouch machine for making open-ended plastic pouches including an improvement for sealing a novel reusable closure in the open end of the pouch.

2. Prior Art

Pouch making machines and methods are known for making open mouth plastic bags or pouches. Fitting a plastic bag or pouch with a reusable fastener is also known. However, there still exists a need for an open mouth plastic pouch having a closure that comprises advantages over known bag closures.

SUMMARY OF THE INVENTION

Accordingly, it is a principal object of the present invention to provide an open mouth plastic bag or pouch having a novel reusable closure for opening and closing the bag or pouch that will provide advantages in use. This is accomplished by providing novel intermediate products that enable closures to be mounted and sealed effectively in the open mouth of plastic pouches as they are being made. To this end, a conventional bag or pouch making machine is modified to facilitate the insertion and positional sealing of the novel closures. A principal advantage of the invention is to be able to produce novel bags or pouches having a unique effective, efficient and economical closure by a simple modification of an existing bag or pouch machine. A further advantage is to provide a unique sealed closure of the pouch having greater mechanical strength in one direction than another.

Other objects and advantages of the present invention will become apparent to those persons skilled in this art from the following detailed description of preferred embodiments of the invention when taken in conjunction with the appended drawings.

BRIEF DESCRIPTION OF THE DRAWINGS

FIGS. 10*a* and 10*b* 2*a* are sections through a plastic pouch or bag showing how the product shown in FIG. 8 is positionally mounted and sealed in an open mouth of the plastic bag or pouch to function in a unique way as a reusable closure; the bag or pouch is shown open in FIG. 10*a* and closed in FIG. 10*b*.

FIG. 12 showing a perspective view and FIG. 12*b* showing a side view.

FIG. 14*a* shows schematically in plan the hook lane used as the starting material; FIG. 14*b* is a transverse section through the hood lane; FIG. 14*c* shows in elevation the application of a heated roller to the hook lane to produce a central groove; FIG. 14*d* shows in elevation the sequential application of a cold roller to the hook lane to form upward interlocking projections in the central groove; FIG. 14*e* shows in elevation the sequential application of a perforation wheel to the hook lane to perforate the hook lane at its longitudinal midline; and 14*f* shows the final product in transverse section.

DETAILED DESCRIPTION OF PREFERRED EMBODIMENTS OF THE PRESENT INVENTION

Figure 1:
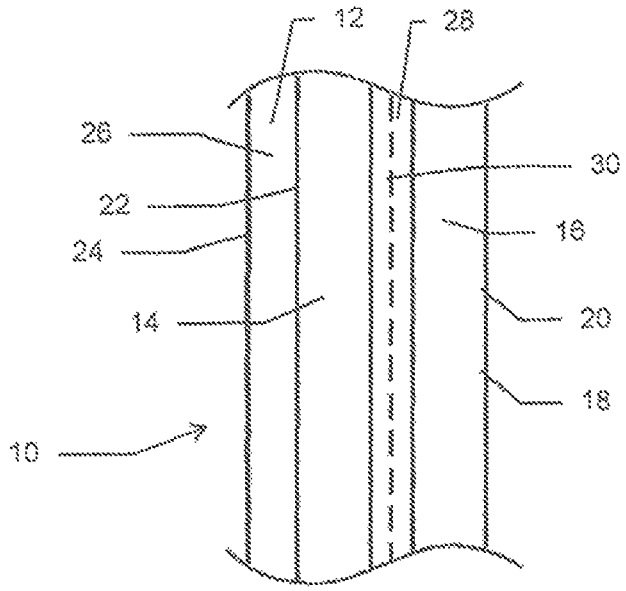
FIG. 1 shows schematically in plan the novel intermediate product of the present invention.

Referring to FIG. 1 one example of the novel intermediate product used to form a closure for an open mouth plastic bag or pouch is schematically shown in plan. The product is an endless tape, or strip or ribbon that can be wound on a bobbin or roll for convenience. The tape 10 is composed of a substrate or base film 12 of a polyolefin or blend of polyolefin. However, any heat sealable material can be used. Base film or substrate 12 is from about 1 mil to about 8 mils thick, with 5 mils being preferred. Sealed onto base film 12 by any known means are two lanes 14 and 16 that coact together and mate to engage and form a fastener. Suitable materials for this purpose would be commercial strips sold by Velcro USA Inc. under the trademark VELCRO. A typical example is one lane been of a hook construction and the other lane being of a loop construction, as well known in the art, so that when pressed together they form a fastener/closure that can be opened by pulling apart. In FIG. 1, the two lanes 14 and 16 are comprised of VELCRO bidirectional hook lanes as the preferred choice. The lanes 14 and 16 extend parallel and are from about ¼ to about 1" wide, with ⅜" being preferred and are spaced apart by web portion 28 of film 12 having a width of from about ⅛" to about ½" with ½" being preferred. The space or substrate portion 28 between the two lanes 14 and 16 constitutes a fold area and is comprised of that portion of film lying between the two lanes. As will be apparent from FIG. 1, lane 16 is co-terminal with edge 18 of film 12 on its side 20 remote from lane 14. Lane 14 on its side 22 remote from lane 16 terminates spaced from edge 24 of film or substrate 12. The substrate or space portion from lane 14 to edge 24 is comprised of base film 12 and constitutes a flange 26 that is from about ⅕" wide to about 1" wide, with ¼" wide being preferred. The dimensions noted above are for commercially make plastic bags or pouches most frequently being made presently. The invention is not restricted to the above dimensions and would be revised according to the size of bag or pouch being made.

Any form of such type of VELCRO fastener can be used, including hook-loop, hook-hook, and other designs sold by Velcro USA Inc. Also, similar fasteners made by others can be used, such as a known mushroom head style, or an arrowhead style as conceived by the inventor hereof. What is important is that the closure be comprised of two parts that coact, engage releasably and mate when pressed together (compressed) to close and seal an opening, but can be subjected to a preselected tension force to uncouple or unmate and re-open and unseal the opening in the pouch for either material to be removed from the pouch or bag or material to be filled into the bag of pouch or bag.

The substrate portion or space 28 between the two lanes 14 and 16 defines a perforation line 30 exactly midway between the two lanes. Perforation line 30 consists of a series of lands interspaced between through cuts. The perforation line 30 ranges from about 50% cut/50% land to about 90% cut/10% land, with about 70% cut/30% land being preferred. The perforation line enables easy and effective folding over and mating of the lanes 14 and 16 during the procedure for making bags or pouches so that the lanes register exactly and are either fully engaged or mated or engaged or mated sufficiently so that further processing to make the bags or pouches does not affect the mating, alignment or registry of the lanes. Perforation line 30 constitutes the fold plane of the folding over. By means of the perforation line 30 as described the making of bags or pouches proceeds in an exceedingly easy and effective way.

Figure 2A:
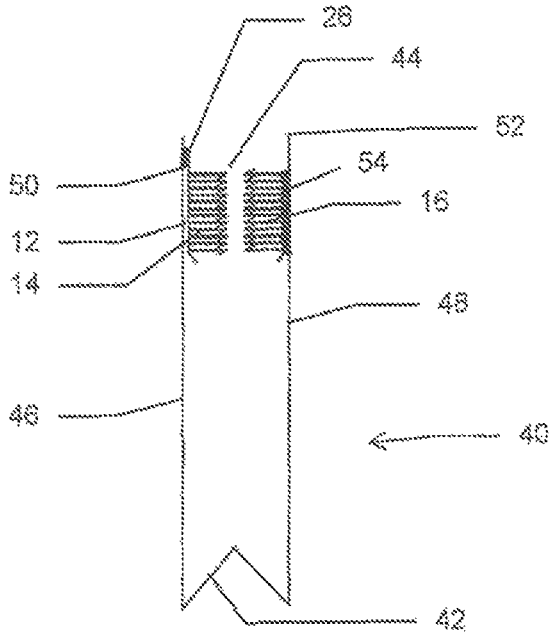
FIG. 2*a* is a section through a plastic pouch or bag showing how the product shown in FIG. 1 is positionally mounted and sealed in an open mouth of the plastic bag or pouch to function in a unique way as a reusable closure; the bag or pouch is shown open.

Referring now to FIG. 2*a*, illustrated in a sectional view through an open finished bag or plastic pouch 40 that shows how the intermediate product described with reference to FIG. 1 (tape 10) is mounted in the open mouth of plastic bag or pouch 40 to function as a reusable closure. As shown, the plastic bag or pouch 40 (hereinafter pouch) has a gusset 42 formed in its bottom so that it can stand up. The pouch 40 with its open top or mouth 44 has two sides 46 and 48. The underside 50 of the substrate or film 12 beneath the flange area 26 is sealed to the inside of the pouch 40 on side 46 spaced slightly down (from about ¼" to about 1") from the top edge 52 of pouch 40. The underside 54 of the substrate or film 12 beneath lane 16 is sealed to the inside of side 48 of pouch 40. The portion of tape 10 that constitutes and underlies lane 14 is not sealed to the interior of the pouch 40 and forms and enables a hinging effect relative to unsealed lane 14. Flange 26 may be sealed for its whole width to the inside of pouch 40 or only sealed for part of its width as shown in FIG. 2*a*.

When the folded tape 10 is mounted and sealed to webs or films 60 and 62 from which pouches are being formed, the perforation line 30 in web 28 is cut to separate or uncouple the lanes 14 and 16 so that thereafter the lanes only couple when engaged face-to-face and are subjected to a compressive force to cause engagement or mating. Although the sealing of the undersides of film 12, as noted, preferably take place by heat sealing, any known way of effecting attachment can be employed.

Figure 2B:
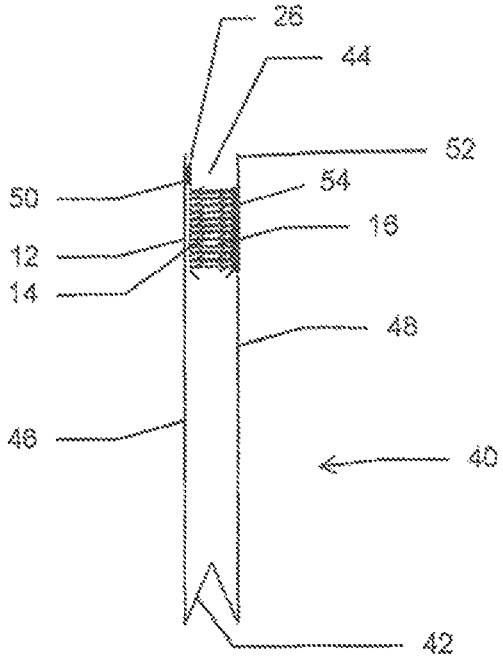
FIG. 2*b* is a section through a plastic bag or pouch, as in FIG. 2*a*, showing the pouch closed and sealed.

FIG. 2*b* shows the pouch 40 with the closure sealed by lanes 14 and 16 being compressed together to engage fully. At this time, any contents in the pouch 40, due to the hinge effect of the lane 14 not being sealed to side 46, will result in tension forces exerted upon the closure of the pouch 40 being greatly reduced with respect to shear forces being exerted upon the closure. This will greatly improve the capability of the closure to withstand forces that would tend to open the sealed closure.

Figure 3:
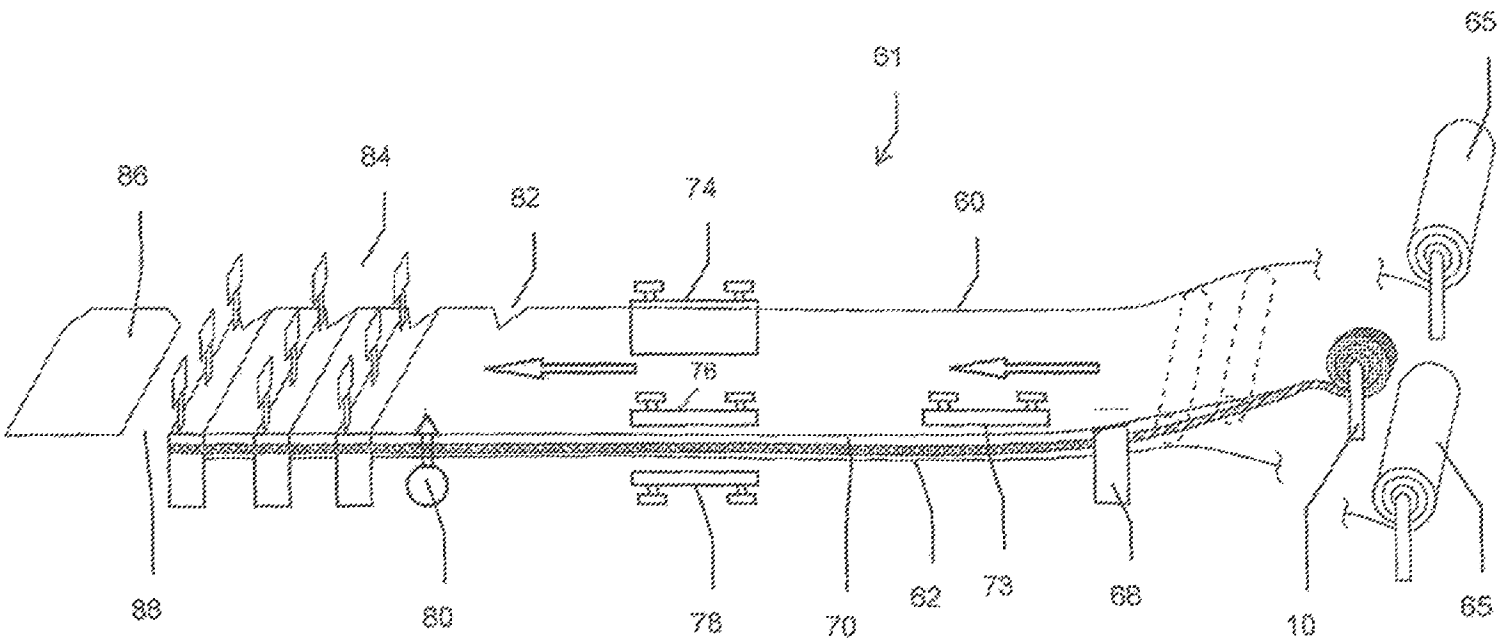
FIG. 3 is a schematic view of a portion of the process for making bags or pouches showing how the intermediate product of FIG. 1 is folded and then inserted between moving continuous webs or films adjacent one side of the webs or films; the webs or films thereafter being processed to result ultimately in bags or pouches.
Figure 3A:
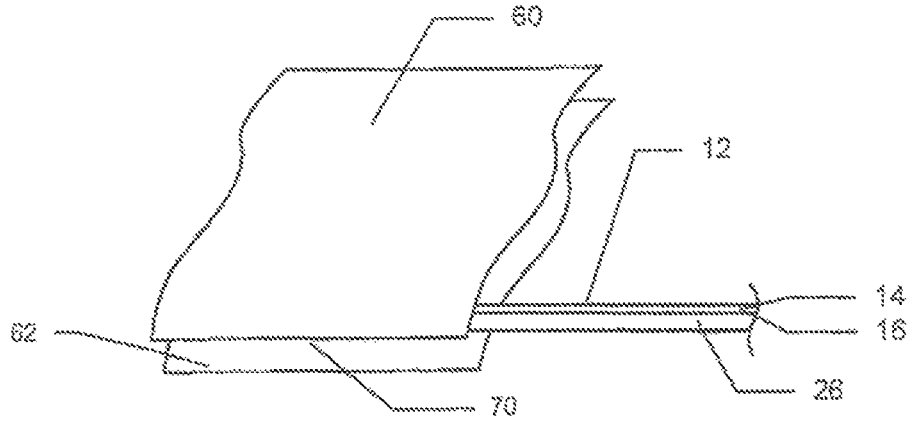
FIG. 3*a* is a schematic view of parallel running continuous webs or films, one on top of the other with the unique tape shown in FIG. 1 inserted between the webs along one of their edges.
Figure 3B:
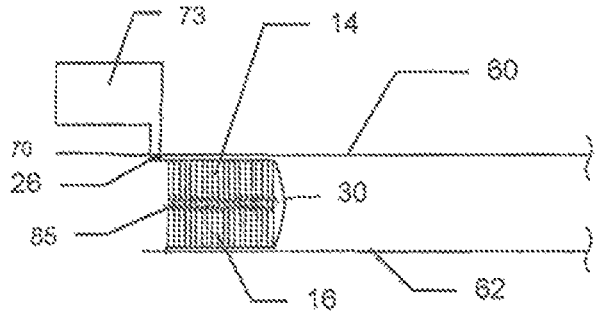
FIG. 3*b* is a sectional view showing the showing the folded tape first being sealed to the top web or film via the action of a pre-sealing unit.
Figure 3C:
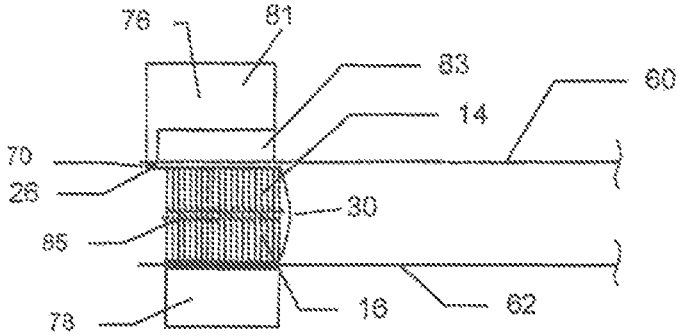
FIG. 3*c* is a sectional view schematically showing the folded tape sealed to the top web or film then being sealed to the bottom web or film via the action of a sealing unit.

Referring now to FIGS. 3, 3*a*, 3*b* and 3*c*, the process for making bags or pouches according to the present invention is shown schematically. As shown, top and bottom continuous webs or films 60 and 62 of suitable plastic material, such as polyolefin, are fed from supply rolls 65 mounted on machine frame 61, noted generally. The films feed via known control and powered rolls (omitted for simplicity), also mounted on the frame 61, so that the top web 60 eventually runs in parallel over the bottom web 62, but is spaced therefrom vertically. A continuous supply of tape 10 is unwound from a supply roll, also mounted on the frame 61, and is fed via dancer control rolls, in a known manner; to a folder 68 situated within the profile of the two webs 60 and 62 adjacent one side thereof, and just before the two webs 60 and 62 are brought together. Tape 10 is fed to the folder 68 with the flange 26 inboard (remote from the adjacent web edge). As tape 10 passes through the folder 68, the flange 26 and hook lane 14 are folded over the hook lane 16 about the perforated line 30 so that the hook lanes 14 and 16 engage in registry exactly and are compressed together during passage through the folder 68 to form a closed fastener generally indicated by reference numeral 85 with the flange 26 now extending outboard (adjacent to) toward adjacent edge 70 of web 60, see FIG. 3*a*. This action is initiated by manually folding over tape 10 in the manner described and leading or threading the initial folded over portion through the folder 68. Thereafter, since tape 10 is fed continuous and being pulled downstream of the folder 68, the folding action about the perforation line 30 will automatically continue as tape 10 is pulled through the folder 68, as will be described in more detail below. The folded tape 10 is positioned so that the flange 26 is spaced a short distance laterally or inboard (from about ¼" to about 1") from adjacent edge 70 of the top web 60. As the tape 10 is folded, the bottom surface of the substrate film 12 beneath flange 26 and lane 14 will be exposed upwardly. Only the portion of the exposed bottom surface of substrate beneath the flange 26 is sealed (heat welded or by adhesive) to the under surface of the top running web 60, see FIG. 3*b*, by means of a presealing unit 73 of designed as a slit seal bar for the flange 26 to hinge after sealing to the top web 60 and to lock the tape 10 in position relative to the webs 60 and 62. The sealed flange 26 acts as a hinge. Next the two webs 60 and 62 are brought together and edges remote from tape 10 are longitudinally sealed at 74 by known means to seal the area that will become the pouch bottoms. The web edges adjacent the tape 10 pass top and bottom sealing devices 76, 78. Device 78 comprises a bottom seal bar to seal correctly the underside of film 12 that lies beneath lane 16 to the top surface of bottom web 62 as shown in FIG. 3*c*. The top device 76 is comprised of a specially designed seal bar 81 for heat and a chilled silicone element 83 to insure that the region covered by the chilled silicone rubber is not sealed, namely, the area including the substrate underlying lane 14 and a small portion of the flange 26. The portion of the substrate to which lane 14 is sealed remains unsealed to the top web.

Next, as shown in FIG. 3 the webs 60 and 62, having the tape 10 sealed to the top web and sealed to the bottom web, as described, advances to a slitter 80 whereupon the fastened top and bottom webs are opened and a slitting tool 80 is inserted to completely cut through the perforation line 30 to separate the two lanes 14 and 16. Finally the bags or pouches are processed to form a gusset as indicated at 82 along the opposite edges of sealed webs 60 and 62, if so desired, and this is done in a conventional known manner. Thereafter the webs 60 and 62 are cross sealed in a known conventional manner as indicated by 84 and finally, the individual bags or pouches 86 are obtained via a conventional and known cutoff device 88. All components are mounted on frame 61.

Figure 4A:
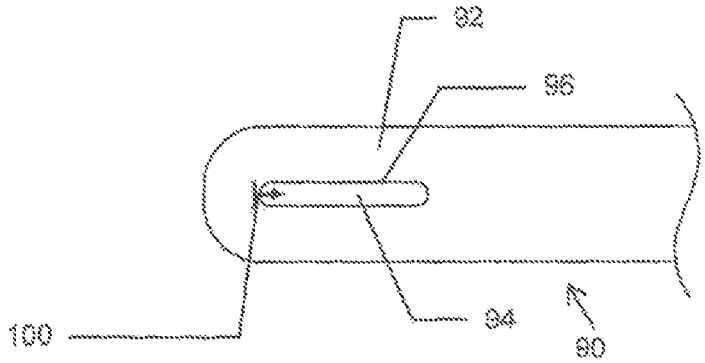
FIG. 4*a* is perspective view partly cut away of a folding tool for effecting folding of the intermediate product (tape of FIG. 1) prior to sealing to the webs or films.
Figure 4B:
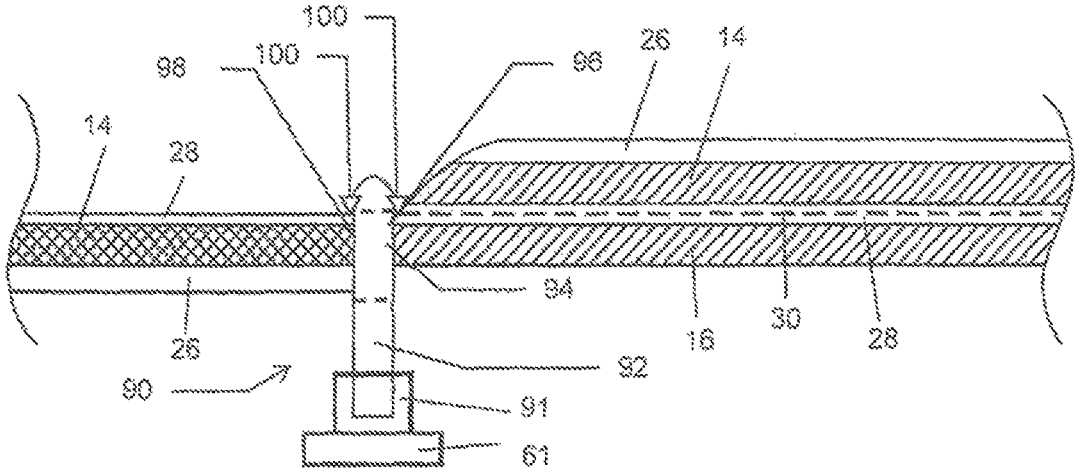
FIG. 4*b* is a top view of the novel tape being folded as it passes through the folding tool mounted for rectilinear adjustment showing the folding showing the folding schematically.

Referring now to FIGS. 4*a* and 4*b*, a novel tool 90 is shown for effecting the folding of the tape 10. This tool consists of an elongated rod or bar 92, mounted on frame 61 via any known conventional rectilinear adjustment 91 that can adjust tool 90 both vertically and horizontally. Tool 90 has an axial extending radial or transverse elongated through hole, orifice or opening 94 extending axially or longitudinally with respect to tool 90 and sized to accommodate the width of a fastener lane 14 or 16 and flange 26. The opening or orifice 94 is dimensioned radially or transversely to accommodate with minimal clearance the two fastener lanes 14 and 16 compressed or mated together when acting as a closure. Entry edge 96 and exit edge 98 of the orifice are rounded or chamfered. Whereas the opening or orifice can have a uniform cross section radially from entry side to exit side, as an alternative or modification, the cross section from entry to exit can gradually diminish or narrow radially. This enables the entry to be larger and accommodate the partially folded tape 10 with the lanes partially engaged at entry and the exit to be narrower to complete the folding and the lanes to be fully engaged and compressed together when the tape 10 exits. The tape 10 traverses the opening or orifice and exits fully mated or engaged.

In a further modification, one of the entry and exit sides of tool 90 has mounted thereon a knife edge 100 that partially protrudes into the path of a folding or folded fastener passing through the orifice for the purpose of intersecting the connecting web 28 between the lanes and cutting through the perforation line 30 of the folded or folding tape 10 to separate the two lanes 14 and 16. Although shown in FIG. 4*b* on both sides of tool 90, only one such slitter or knife edge 100 is required. The slitting can take place only after the fastening elements of the two fastener lanes 14 and 16 have sufficiently engaged so that thereafter any forces placed on the fastener lanes do not prevent or disturb their engagement, mating or registry when folded or after being folded. Although the folding commences upstream of the folder rod 92 and the fastening elements of the lanes 14 and 16 already have engaged at the time of passage into the entry of the orifice 94, nevertheless, a slitter 100 at the exit of the orifice may be preferred as at this point the fastener lanes 14 and 16 are fully engaged, mated and in registry.

FIG. 4*b* shows a tape 10 passing through the orifice shown in FIG. 4*a*. As will be evident from FIG. 4*b*, the laid-open tape 10 is fed to the entry 96 of the orifice of rod 92. Emerging from the orifice, due to the folding action, the lanes 14 and 16 are in registry with lane 14 on top and flange 26 is protruding on one side and the substrate portion 28 is protruding on the other side, cut through at the perforation line 30 or not depending if a slitter is being used or not and on placement of the slitter 100. As noted previously, alternatively, a slitter tool 80 can be located downstream of the sealing of the tape 10 to the two travelling webs 60 and 62, see FIG. 3. The substrate 12 covers lane 14 but only flange 26 and substrate portion 28 is shown in FIG. 4*b* for simplicity.

Figure 5A:
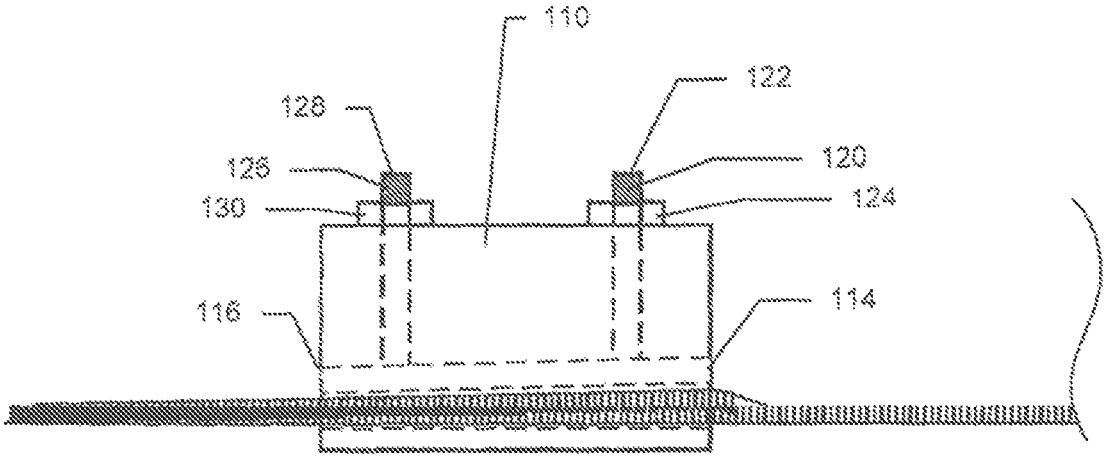
FIG. 5*a* is a side view showing another folding tool having adjustability and schematically showing the folding operation.
Figure 5B:
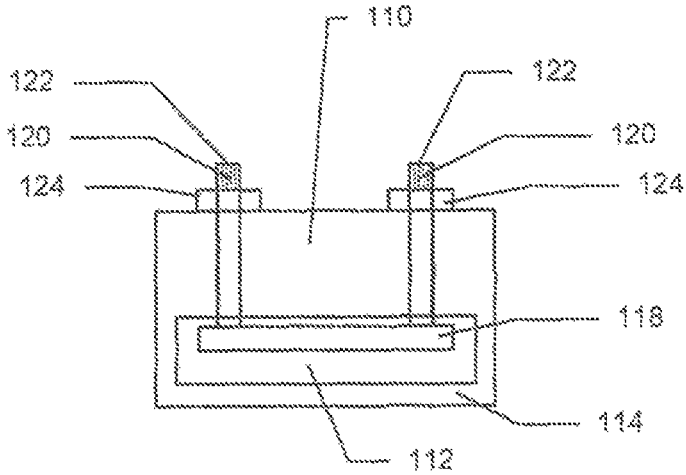
FIG. 5*b* is an end view of the folding tool shown in FIG. 5*a*.
Figure 5C:
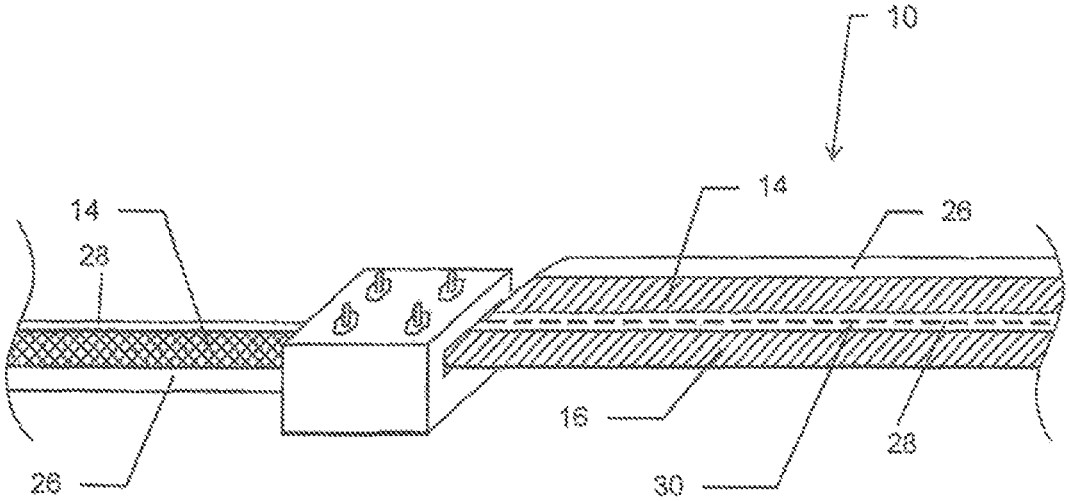
FIG. 5*c* is a perspective view of the folding tool shown in FIG. 5*a* schematically showing the folding operation.

A modified folder is shown in FIGS. 5*a*, 5*b* and 5*c*. As shown, the folder consists of a housing 110 having a hollow interior, an entry slot 114 and an exit slot 116. A plate 118 is mounted in the interior of housing 110 via a pair of bolts 120 fixed to the front of the plate 118 adjacent the entry slot 114. Bolts 120 pass through openings in housing 110 and protrude above the top of the housing 110. Bolts 120 are threaded on their free ends 122 onto which nuts 124 are threaded and can be rotated to adjust the vertical position of the plate 118 relative to the entry 114. A second pair of bolts 126 is fixed to the rear of plate 118 adjacent the exit slot 116. Bolts 126 pass through openings in housing 110 and protrude above the top of the housing 110. Bolts 126 are threaded on their free ends 128. Nuts 130 are threaded onto the bolts 126 and by rotating nuts 130 the vertical position of the plate 118 can be adjusted relative to the exit 116. As the folding of tape 10 takes place in housing 110, the tape entering the housing requiring more vertical space as the folding is only in process, whereas the folded tape 10 exiting housing 110 is more compressed in a vertical sense and requires less vertical space. Accordingly, the plate 118 is adjusted so that the front end adjacent to entry slot 114 is positioned higher in the housing interior 112 than the rear end of the plate 118 adjacent to the exit 116 of housing 110. This is evident as the plate 118 tilts from front to back as shown in FIG. 5*a*.

FIG. 5*c* shows tape 10 passing through the folder. Tape 10 is introduced to the folder in a laid out flat condition as shown in FIG. 1. As previously explained the tape 10 is initially folded over manually about the perforated line 30 and threaded through the entry slot 114 and pulled out the exit slot 116 to initiate the folding operation. This produces a curling of the tape 10 as it approaches the entry slot 114 initiating a folding action. Then the folding operation will take place automatically as the folded tape 10 is pulled from the exit slot 116 of the folder as the tape upstream of the entry slot 114 is curling and being folded just prior to its entry into the housing. As noted above, except for flange 26 and substrate portion 28, the rest of the substrate on the downstream side of the folder is not shown for clarity, so what is shown in FIG. 5*c* is the back of lane 14 covering lane 16 and the back of the flange and substrate portion 28.

Figure 6:
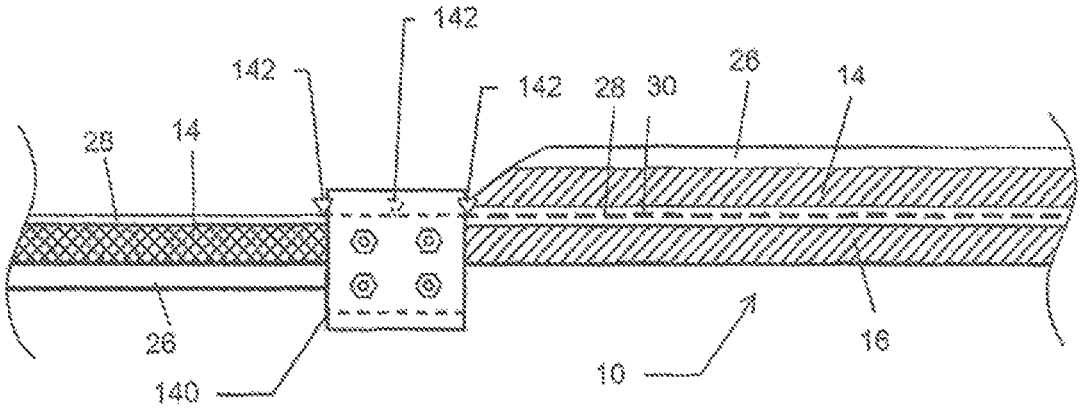
FIG. 6 is a schematic view of the folding operation in conjunction with a slitter for performing a slitting operation with optional locations for the slitting tool shown.

FIG. 6 is a further schematic showing of the folding operation to prepare the tape 10 for sealing in a plastic bag or pouch. As shown, a folder 140, like the folder described in conjunction with FIG. 5*a-c*, is fed with a laid out tape 10 as described in conjunction with FIG. 5*c*. The folder 140 has mounted thereon a knife edge or slitter 142 at one of the entry slot or exit slot of the folder or inside of the housing intermediate the entry and exit. Although a slitter 142 is shown at three possible locations in FIG. 6, only one is required.

Figure 7:
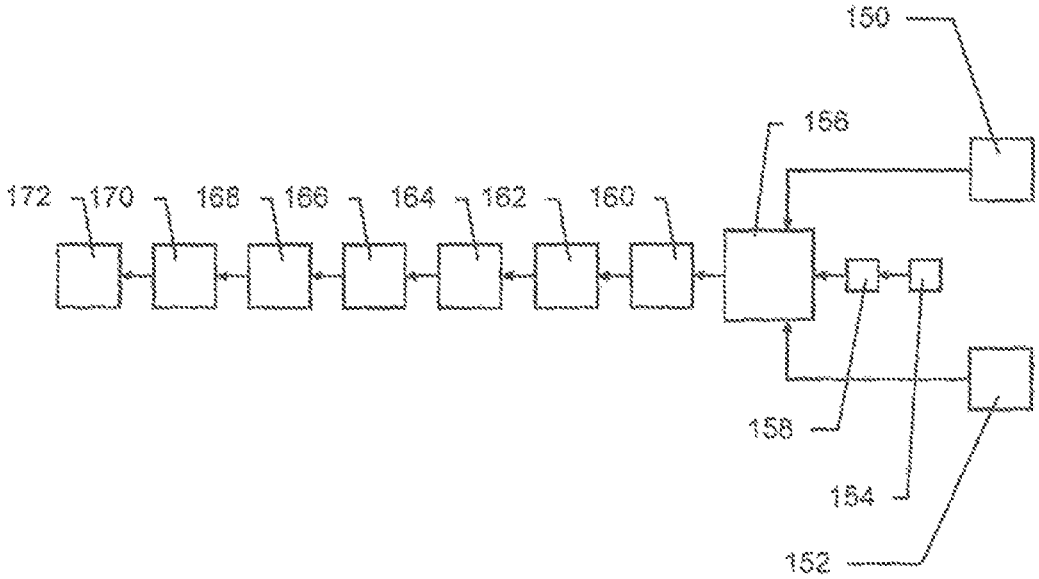
FIG. 7 is a block diagram illustrating the improvements to a pouch making machine essential to carry out the present invention.

FIG. 7 shows in block diagram the essential components of a machine for making bags or pouches according to the present invention. The machine consists of a frame to mount and support all the machine components. Mounted on the frame are supply rolls 150 and 152 for feeding webs of plastic film used to make the bags or pouches, and a supply roll 154 for feeding the tape 10 in a laid out form.

The plastic webs are fed to a station 156 where they are running one over the other with the folded tape 10 running between them. The tape 10 is fed to a folder 158 which serves as a restriction point, as described herein, and then to the station 156 for attachment to the webs. The webs and folded tape 10, correctly adjusted and juxtaposed, are fed to a first sealing station 160 including a presealing and slit sealing unit operating with constant motion for sealing the flange of the folded tape 10 to the top web adjacent one edge, as described herein, to lock the closure tape 10 in position relative to the webs. The webs and folded tape 10 are then fed to station 162 including a top and bottom sealing unit where the flange is fully sealed to the top web while a chiller is applied to the area corresponding to the lane 14 to prevent it being sealed to the top web while lane 16 of the folded tape is sealed to the bottom web adjacent to the corresponding edge. Also, the opposite edges of the webs are sealed by a known unit to form the bottom of the bags or pouches being made. The webs are fed to a slitting station 164 for perforation separation where the closure of the webs is opened, a slitting tool inserted and the perforation line 30 of tape 10 is cut through and separated completely so that lanes 14 and 16 of tape 10 are separated. Next the webs advance optionally to a gusseting station 166 where a gusset is formed in the portion of the webs that will be bag or pouch bottoms. The webs are then passed to a cross sealing station 168 where the sides of the bags or pouches are sealed, and then to a cut-off station 170 where the bags or pouches are individuated, and finally to a product collection station 172. As noted all components are mounted preferably on a common machine frame. The cutting of the perforation line 30 results in the closure being sealed to each side of the mouth of the bags or pouched produced and to enable the bags or pouches to be opened by pulling apart the lanes 14 and 16 forming the fastener, whereupon material or product can be poured in or otherwise filled into the bag of pouch and then the closure can be closed by pressing the two lanes 14 and 16 together. The drives of the machine and the necessary roller arrangements have been omitted for simplicity and are well known and understood by persons of ordinary skill in the art.

Figure 8:
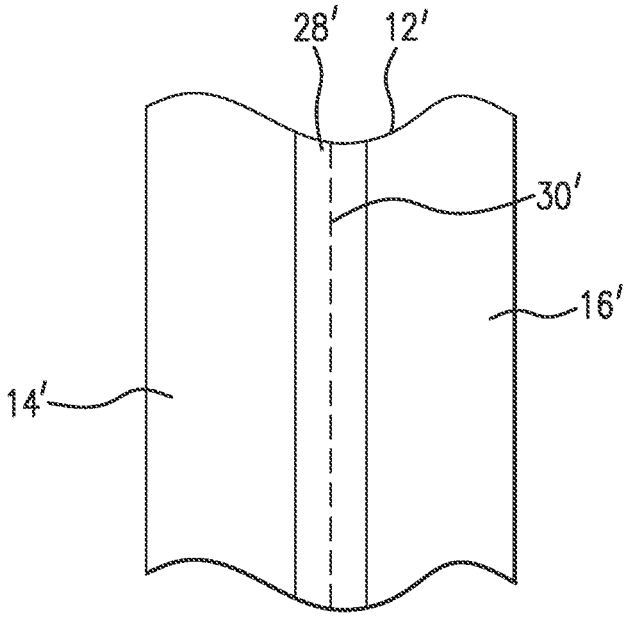
FIG. 8 shows schematically in plan a further embodiment of the novel intermediate product of the present invention.
Figure 9:
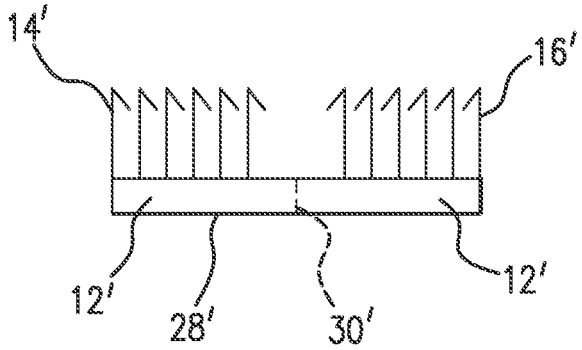
FIG. 9 is a transverse section through the product of FIG. 8.

A further inventive intermediate product is shown schematically in FIGS. 8 and 9. As shown, the inventive product consists of an elongated member 10' having two spaced parallel hook lanes 14' and 16', each from ⅛ to ¾ inches wide, integrally formed on an underlying plastic planar base member 12'. The space 28' between the lanes is from about 1/16 to ½ inches wide. At the middle of the space is a longitudinal perforated midline 30'. The intermediate product is like that described in conjunction with FIG. 1. Each lane 14' and 16' terminates even with the edges of base member 12'.

The substrate portion or space 28' between the two lanes 14' and 16' defines a perforation line 30' exactly midway between the two lanes. Perforation line 30' consists of a series of lands interspaced between through cuts. The perforation line 30' ranges from about 50% cut/50% land to about 90% cut/10% land, with about 70% cut/30% land being preferred. The perforation line enables easy and effective folding over and mating of the lanes 14' and 16' during the procedure for making bags or pouches so that the lanes register exactly and are either fully engaged or mated or engaged or mated sufficiently so that further processing to make the bags or pouches does not affect the mating, alignment or registry of the lanes. Perforation line 30' constitutes the fold plane of the folding over. By means of the perforation line 30' as described the making of bags or pouches proceeds in an exceedingly easy and effective way.

Figure 10A:
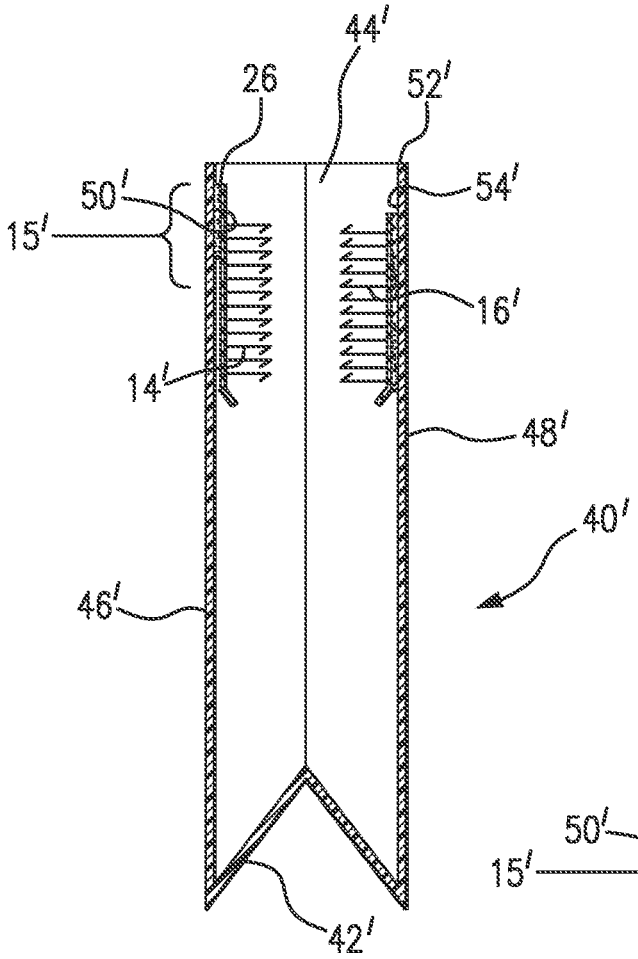

Referring now to FIG. 10*a*, illustrated in a sectional view through an open finished bag or plastic pouch 40' that shows how the intermediate product described with reference to FIG. 8 is mounted in the open mouth of plastic bag or pouch 40' to function as a reusable closure. As shown, the plastic bag or pouch 40' (hereinafter pouch) has a gusset 42' formed in its bottom so that it can stand up. The pouch 40' with its open top or mouth 44' has two sides 46' and 48'. The underside 50' of the substrate or film 12' beneath hook lane 14' is sealed partially to the inside of the pouch 40' on side 46' spaced slightly down (from about ¼" to about 1") from the top edge 52' of pouch 40'. The underside 54' of the substrate or film 12' beneath lane 16' is sealed entirely to the inside of side 48 of pouch 40. The portion of tape 12' that constitutes and underlies lane 14' is not sealed entirely, but only the upper portion 15' is sealed to the interior of the pouch 40' and forms and enables a hinging effect relative to unsealed lower portion lane 14'.

Figure 10B:
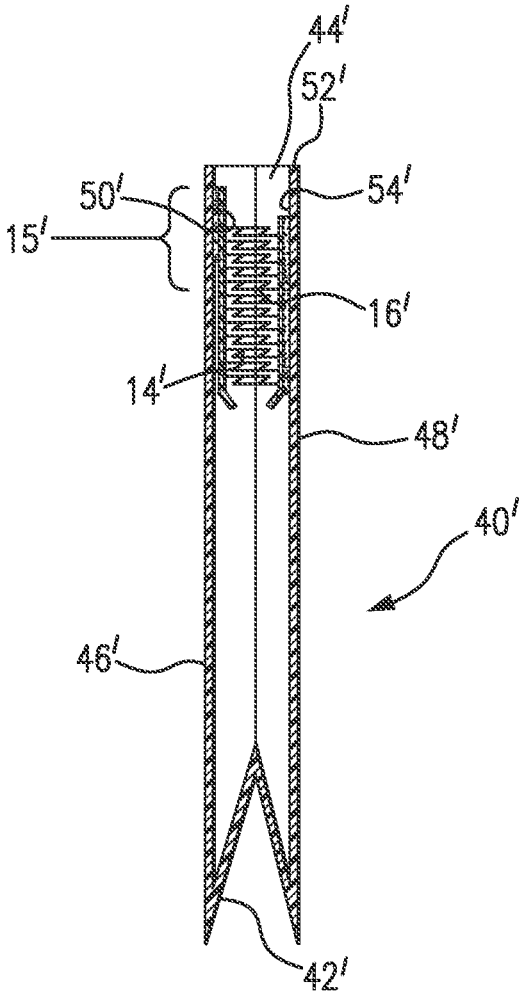

FIG. 10*b* shows the pouch 40' with the closure sealed by lanes 14' and 16' being compressed together to engage fully. At this time, any contents in the pouch 40', due to the hinge effect of the lane 14' not being sealed entirely to side 46', will result in tension forces exerted upon the closure of the pouch 40' being greatly reduced with respect to shear forces being exerted upon the closure. This will greatly improve the capability of the closure to withstand forces that would tend to open the sealed closure.

When the folded tape 12' is mounted and sealed to webs or films from which pouches are being formed, the perforation line 30' in web portion 28' provides precise folding and preslitting to ease the final opening. The perforation line 30' is cut to separate or uncouple the lanes 14' and 16' so that thereafter the lanes only couple when engaged face-to-face and are subjected to a compressive force to cause engagement or mating. Although the sealing of the undersides of film 12, as noted, preferably take place by heat sealing, any known way of effecting attachment can be employed.

Figure 11:
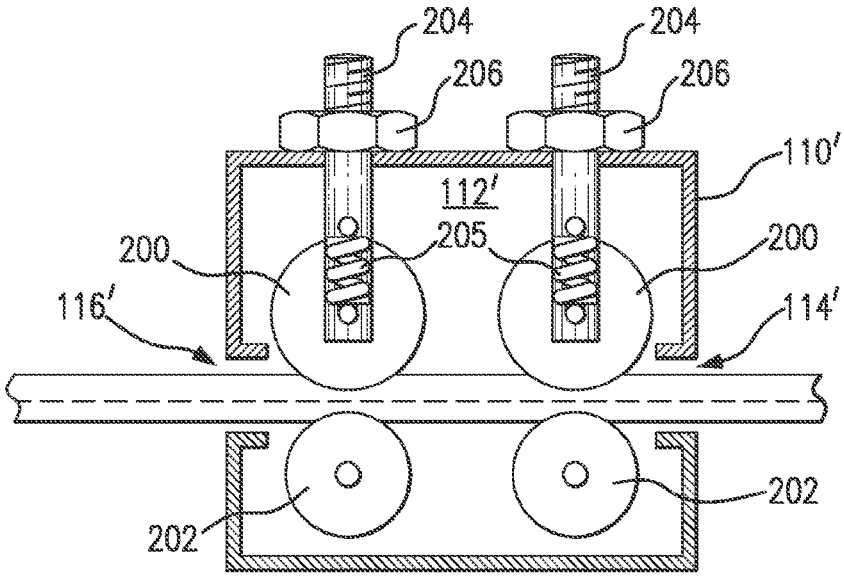
FIG. 11 shows schematically another embodiment of a folding tool.

Another inventive modified folder is shown in FIG. 11. As shown, the folder consists of a housing 110' having a hollow interior 112'0, an entry slot 114' and an exit slot 116'. A pair of roller sets 200,202 is mounted in the interior of housing 110'. Each set of rollers 200,202 is mounted with roller 200 on top of the other roller 202 with a nip between them. Bolts 204 with cooperating nuts 206 are fixed to the axle of each roller 200 to enable rollers to be adjusted independently in a vertical direction, to control nip. Bolts 204 pass through openings in housing 110' and protrude above the top of the housing 110'. Bolts 204 are threaded on their free ends onto which nuts 206 are threaded and can be rotated to adjust the vertical position of roller 200 relative to the entry 114' and exit 116'. As the folding of tape 12' takes place in housing 110', the tape entering the housing requiring more vertical space as the folding is only in process, whereas the folded tape 12' exiting housing 110' is more compressed in a vertical sense and requires less vertical space. Accordingly, the front roller set is adjusted so that the front end adjacent to entry slot 114' is positioned higher in the housing interior 112' than the rear roller set adjacent to the exit 116' of housing 110. This is evident front to back as shown in FIG. 11. Further, to accommodate thickness discontinuities in the tape 12', it is desirable to include a compression spring 205 in each adjustable mounting to provide flexibility and to allow the rollers 200 to move up or give responsive to passing of a thickness discontinuity and then move down and return to its adjusted position when the discontinuity has passed.

Figure 12A:
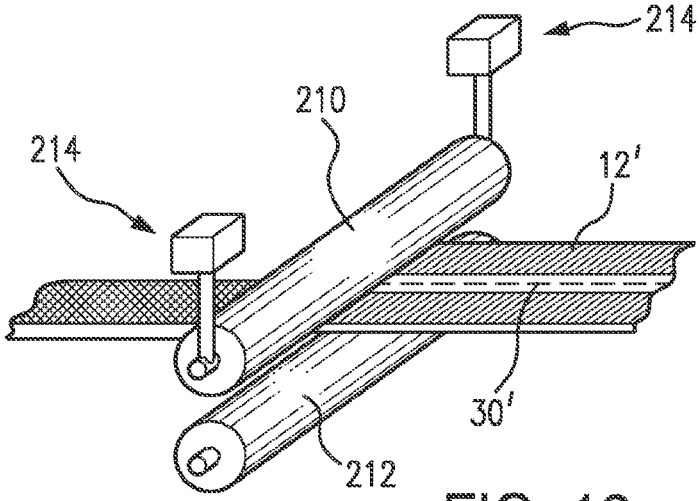
FIGS. 12*a* and 12*b* show schematically still another embodiment of a folding tool.
Figure 12B:
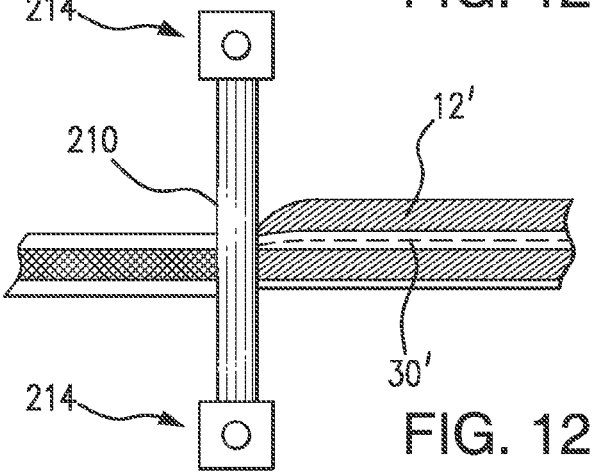

FIGS. 12*a* and 12*b* show schematically still another inventive modified folder. As shown, the folder consists of a pair of rollers 210,212 arranged with a nip through which the tape 12' can pass and be folded. The axle of the top roller 210 is mounted on an adjustable support 214 in any know manner so that its vertical position relative to the lower roller 212 (nip) can be changed. The mechanism to accomplish this function is well known to persons of ordinary skill in the art and therefore will not be described in detail. The tape 12' passes through the nip of the rollers and is folded about the perforated line 30', pinched so that the lanes 14' and 16' engage and are closed under preselected pressure.

Figure 13A:
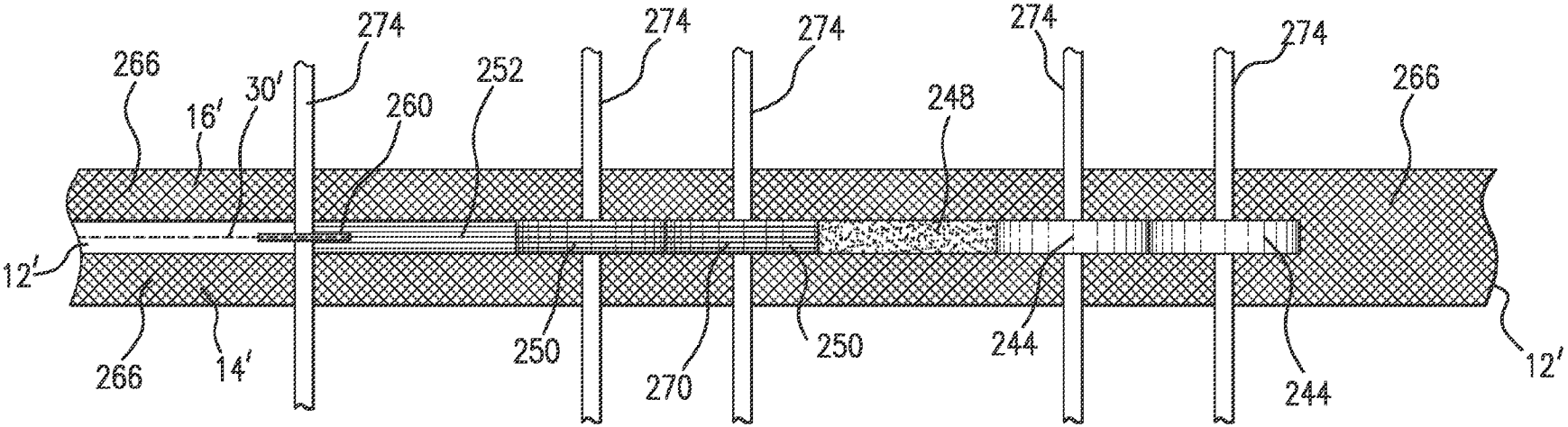
FIGS. 13*a* and 13*b* showing schematically, respectively, a top perspective view of a method for making a further embodiment of the product of the present invention; and a side view of the method.
Figure 13B:
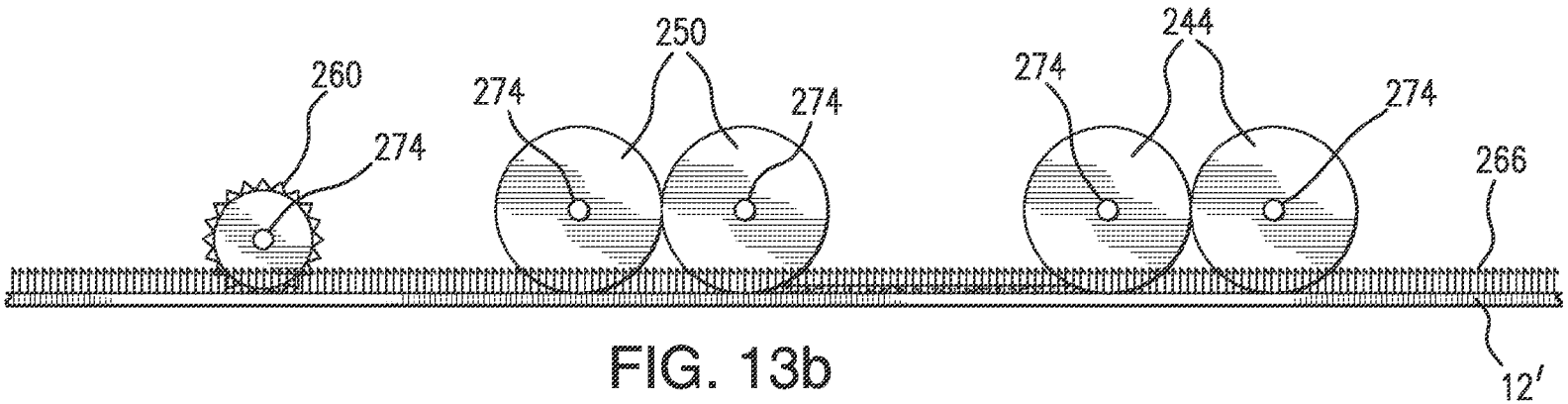
Figure 14A:
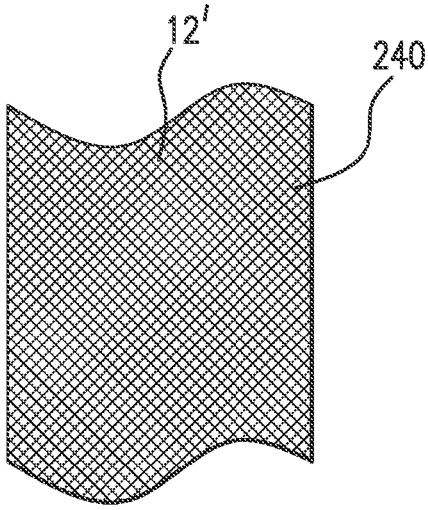
FIGS. 14*a-f* show schematically further details of the method shown in FIGS. 13*a* and 13*b*.
Figure 14D:
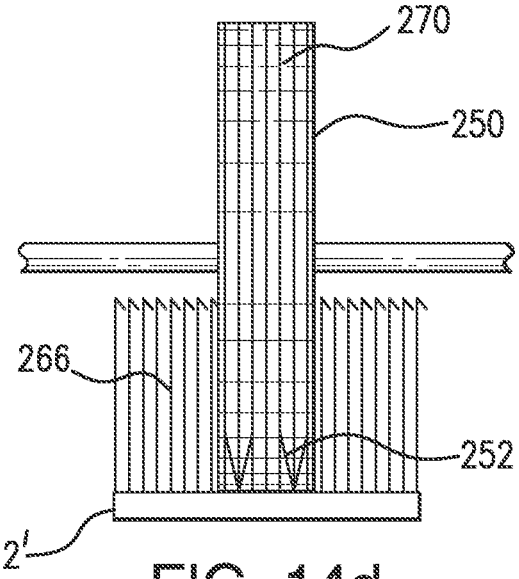
Figure 14B:
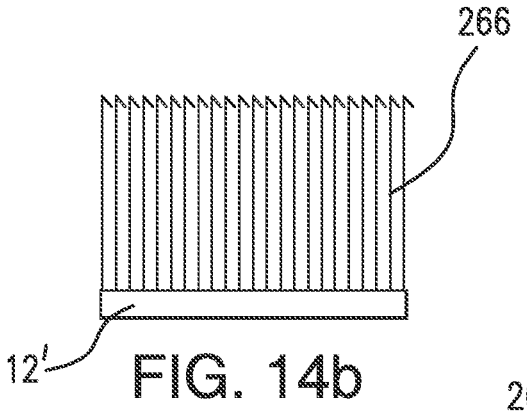
Figure 14E:
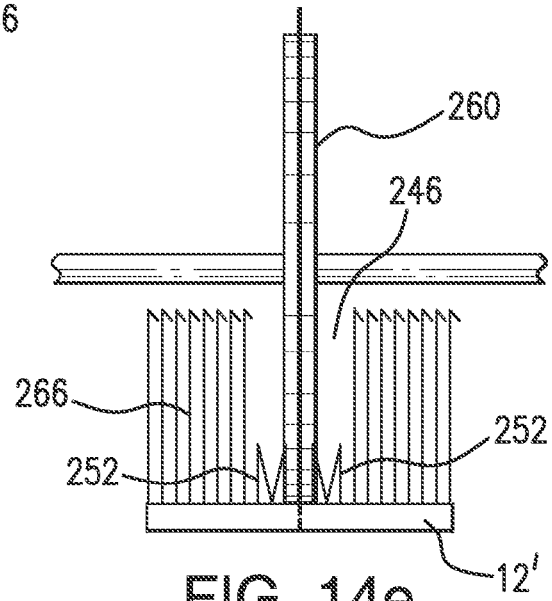
Figure 14C:
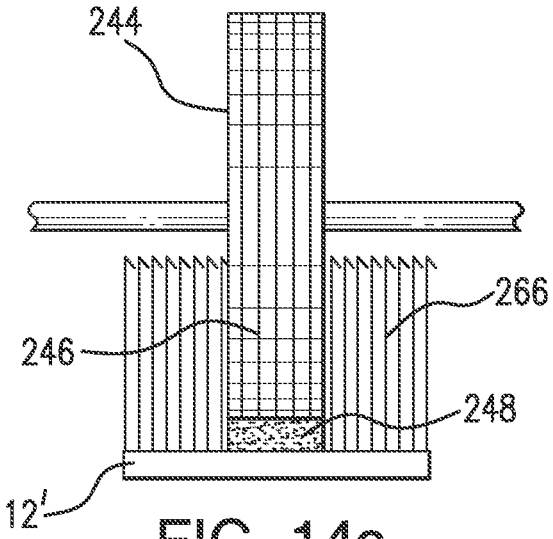
Figure 14F:
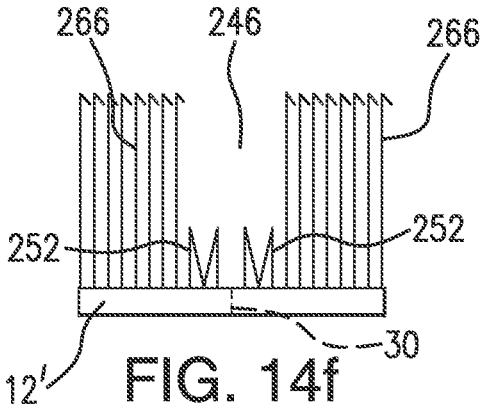

FIGS. 13*a*, 13*b* and FIGS. 14*a-f* show schematically an inventive and novel method of preparing an inventive and novel product 12' from an elongated single hook lane 240, from about ¼ to 2 inches wide, shown in FIG. 14*a* and FIG. 14*b*. In the first step of the method as shown in FIGS. 13*a*, 13*b*, and more particularly shown in FIG. 14*c*, a pair of hot rollers 244 serially arranged or forming bar is used to flatten the hooks 266 in the central area of the hook lane 240 to form a groove 246 in the hook lane with a molten mass of plastic 248 at the bottom of the groove. Other means can be used for this purpose to slit seal, mold or flatten the central hooks. Sequentially, as show in FIGS. 13*a*, 13*b*, and FIG. 14*d*, and while the plastic mass 248 is still relative molten, an adjustable pair of cold rollers 250 serially arranged and having forming grooves or recesses 270 on its periphery are driven in the groove 246 to final form solid spaced ridges or flanges 252 on either side of the midline hook lane that will overlap and interlock when the lane is folded. The function of this step is to form an interlocking of the folded over hook lane more strongly than were the folding over just being held by the engagement of the hooks alone. Sequentially, as shown in FIGS. 13*a*,13*b*, and FIG. 14*e* a perforation wheel 260 engages the longitudinal midline of the hook lane in the space between the ridges 252, and perforates the hook lane form a perforation 30' consisting of lands and through cuts as previously described. The final elongated inventive product 12' is shown in FIGS. 13*a*,13*b*, and transverse section in FIG. 14*f* with spaced hook lanes 14' and 16' and a perforated midline with interlocking projections 252 extending upwardly between the perforated midline 30' and each hook lane 14', 16'. When the product 12' is folded over precisely at the perforated line 30' the interlocking projections 252 interlock and give the closure greater strength. The interlocking projections are designed to be readily attachable and detachable so that the closure while more secure can be readily opened. Also, it is possible to form the interlocks regarding their geometrical configuration such that they interlock in an airtight or liquid tight manner, as is known in the art. Shown schematically in FIG. 13*a*, 13*b* each of the wheel 260 and rollers 244,250 are mounted on axles 274 carried in bearings adjustably mounted and driven by motors and gearing in a conventional manner, the details of which will be readily apparent to those of skill in the art. The novel inventive method shows how a novel inventive intermediate product can be produced directly from a single hook lane of plastic. This product is then used as previously described and applied in the process for making bags or pouches according to the present invention as shown schematically in FIGS. 3, 3*a*, 3*b* and 3*c*. Hook lanes 14' and 16' are heat sealed to the plastic webs as described with reference to FIGS. 10*a* and 10*b*.

Although it has been previously described herein that the two sides of the closure are partially sealed on one side and fully sealed on the other side to the two webs or the opposite sides of a bag or pouch to create a hinge, nevertheless, where a hinge is not necessary, it is possible to fully seal both sides of the closure to the two webs or opposite sides of a bag or pouch.

Although the invention has been described in terms of specific embodiments to enable persons of ordinary skill in the art to make and use the invention, nevertheless changes, modifications and further embodiments will be evident to such persons which do not depart from the teachings herein. Such are deemed to be included in the scope of the invention as set forth in the appended claims.

What is claimed is:

1. A process of making a plastic bag or pouch comprising the steps of:

running a pair of plastic webs juxtaposed one spaced above another;

introducing a tape into the space between said webs adjacent one side thereof, said tape being comprised of an elongated plastic film having a top surface and a bottom surface, a pair of elongated attachment lanes sealed to said film on the top surface, said lanes composed of complementary fastening elements to effect an attachable-detachable closure, said lanes extending parallel and being spaced apart, a single perforation line formed in said film midway between said lanes, and said film on the top surface defining a flange on one side of said lanes;

folding said tape along the perforation line by pulling through a slot so that the lanes engage in registry inside the folded tape with the flange extending therefrom with the bottom surface being exposed;

sealing the bottom surface of the folded tape underlying the flange of said tape to one of said plastic webs adjacent said one side without sealing the lane adjacent the flange to said one side;

sealing the bottom surface of the folded tape underlying the lane of said tape remote from said flange to the other plastic web adjacent said one side;

cutting the tape along the single perforation line to separate the two lanes;

disengaging the lanes to separate the webs; and processing the plastic webs into bags or pouches having a mouth with the lanes of said tape sealed to opposite sides of the mouth inside the bag or pouch to provide a closure for the bag or pouch.

2. The process according to claim 1 wherein the separation of the tape along the perforation line occurs after sealing the tape to the webs.

3. The process according to claim 1 wherein the separation of the tape along the perforation line occurs just after folding of the tape.

4. A process of making a plastic bag or pouch comprising the steps of:

running a pair of plastic webs juxtaposed one above another;

introducing a tape between said webs adjacent one side thereof, said tape being comprised of a substrate and a pair of elongated sets of complementary fastening elements formed integral with and projecting normal to the substrate to effect an attachable-detachable closure, said sets of complementary fastening elements extending parallel and being spaced apart with each set co-terminal with an edge of said substrate, and a single perforation line formed in said substrate midway between said lanes, whereupon said substrate is foldable along said perforation line to place said lanes face-to-face in registry engagement;

folding said tape along the single perforation line by pulling through a slot so that the lanes are engaged;

sealing the portion of said tape underlying one lane to one of said plastic webs adjacent said one side;

sealing the portion of said tape underlying the other lane to the other plastic web adjacent said one side;

separating the tape along the single perforation line;

disengaging said lanes to separate the plastic webs; and processing the plastic webs into bags or pouches having a mouth with the lanes of said tape sealed to opposite sides of the mouth inside the bag or pouch to provide a closure for the bag or pouch.

5. The process according to claim 4 including the further steps of sealing one lane of said tape only partially to one of said plastic webs adjacent said one side, and sealing the other lane of said tape fully to the other plastic web.

6. The process according to claim 5 wherein the separation of the tape along the perforation line occurs one of before and after folding of the tape.

7. A process of making a plastic bag or pouch comprising the steps of:

a) running a pair of plastic webs juxtaposed one spaced above another;

b) introducing a tape into the profile of said webs adjacent one side thereof;

c) said tape being comprised of an elongated plastic film, a pair of elongated attachment lanes integral with said film, said lanes composed of complementary fastening elements to effect an attachable-detachable closure, said lanes extending parallel and being spaced apart transversely, a single perforation line formed in said film midway in the space between said lanes;

d) folding said tape along the single perforation line by pulling through a slot so that the lanes are fully engaged inside the folded tape;

e) longitudinally sealing only the outer part of one side of the folded tape remote from the single perforation line to one of said plastic webs relative to its longitudinal edge;

f) longitudinally sealing the other side of said folded tape to the other plastic web relative to its longitudinal edge without affecting the partial sealing of the one side;

g) separating the tape along the perforation line to separate the two lanes;

h) disengaging the two lanes to separate the two plastic webs; and i) processing the plastic webs into bags or pouches having a mouth with the lanes of said tape sealed to opposite sides of the mouth inside the bag or pouch to provide a closure for the bag or pouch.

8. The process of claim 7 wherein the single perforation line of the tape comprises from about 50% lands and about 50% cut through to about 10% lands and about 90% cut through.

9. The process of claim 8 wherein the perforation line comprises at least about 70% cut through.

10. The process of claim 7 wherein the attachment lanes are from about ½ to about 1" wide, and from about ⅛ to about ½" apart.

11. The process of claim 10 wherein the attachment lanes are ⅜" wide, and spaced apart ¼".

12. The process of claim 7 wherein the complementary fastening elements are hooks.

13. A process of making plastic bags or pouches comprising the steps of:

(a) running a pair of elongated plastic webs, having transverse edges in alignment, longitudinally juxtaposed one spaced from the other so that the webs have facing surfaces;

(b) introducing an elongated tape into the space defined between the facing surfaces of the pair of plastic webs on one side thereof adjacent the aligned edges of said webs, said tape being composed of heat sealable elongated plastic film having opposed edges and a first side and a second side, a first attachment lane of a pair of elongated attachment lanes sealed to said film on the first side thereof parallel to the longitudinal axis, and a second attachment lane of the pair of elongated attachment lanes sealed to said film on the first side thereof parallel to and transversely space from said first attachment lane, said attachment lanes including complementary fastening elements to effect an attachable-detachable closure, and a single perforation line formed in said film midway between said lanes;

(c) folding said film at a folding station along the perforation line to engage the complementary fastening elements of the attachment lanes on the first side of the film, within the folded film, so that the second side of the film faces outwardly on both sides of the folded film;

(d) sealing the second side of the film on one side of the folded film to the facing surface of one of said plastic webs on said one side thereof adjacent the edge thereof;

(e) sealing the second side of the film on the other side of the folded film to the facing surface of the other of said plastic webs on said one side thereof adjacent the edge thereof;

(f) cutting the single perforation line in said film between the engaged attachment lanes to separate the film into two parts, each part of which contains an attachment lane and each part of which is sealed to a web;

(g) disengaging the engaged attachment lanes to separate the two webs; and (h) processing the separated plastic webs into bags or pouches each having a mouth with the two parts of the film sealed inside said bags or pouches on opposite sides of the mouths of the bags or pouches to provide closures for the bags or pouches.

14. The process of claim 13 wherein said first attachment lane is sealed to said film co-terminal with one opposed edge thereof.

15. The process of claim 13 wherein said second attachment lane is sealed to said film spaced from one opposed edge thereof.

16. The process of claim 13 wherein said first attachment lane is sealed to said film co-terminal with one opposed edge thereof and said second attachment lane is sealed to said film spaced from the other opposed edge thereof to define a flange.

17. The process of claim 16 wherein the second side of the film underlying the first attachment lane is sealed on one side of the folded film to the facing surface of one of said plastic webs on said one side thereof adjacent the edge thereof; and the second side of the film underlying the defined flange is sealed on the other side of the folded film to the facing surface of the other of said plastic webs on said one side thereof adjacent the edge thereof.

18. The process of claim 17 wherein the portion of the second side of the film underlying the second attachment lane is unsealed from the facing surface of the other of said plastic webs.

19. The process of claim 13 wherein the step of folding said film at a folding station includes the further steps of pulling said film through a slot to engage the attachment lanes, and compressing the engaged attachment lanes together.

20. The process of claim 13 wherein the complementary fastening elements for both attachment lanes are hooks.

* * * * *